US006555771B2

(12) United States Patent
Shao

(10) Patent No.: US 6,555,771 B2
(45) Date of Patent: Apr. 29, 2003

(54) ELECTRIC SHOCK-PROOF SECURITY DEVICE OF A RECEPTACLE

(76) Inventor: Hung-Chiang Shao, No. 59-2, Sec. 3, Pa Te Rd., Pan Chiao City, Taipei (TW)

( * ) Notice: Subject to any disclaimer, the term of this patent is extended or adjusted under 35 U.S.C. 154(b) by 0 days.

(21) Appl. No.: 09/729,314

(22) Filed: Dec. 5, 2000

(65) Prior Publication Data

US 2002/0066656 A1 Jun. 6, 2002

(51) Int. Cl.[7] ..... H01R 13/70
(52) U.S. Cl. ..... 200/51 R; 439/137
(58) Field of Search ..... 200/51 R, 51.02–51.9; 439/137, 145

(56) References Cited

U.S. PATENT DOCUMENTS 4,822,290 A * 4/1989 Cauley et al. ..... 439/137
6,217,353 B1 * 4/2001 Yu-Tse ..... 439/145
6,238,224 B1 * 5/2001 Shao ..... 439/137

* cited by examiner

*Primary Examiner*—Lincoln Donovan
*Assistant Examiner*—Lisa N Klaus
(74) *Attorney, Agent, or Firm*—Varndell & Varndell, PLLC

(57) ABSTRACT

An electric shock-proof security device of a receptacle is disclosed, describing in particular when an undesired object is inserted into the receptacle, the electric shock-proof security device serves to prevent the user from getting an electric shock. The device comprises a cover, two stoppers, springs and a supporting seat. The two stoppers include a right stopper and a left stopper. The right and left stoppers are integrally formed pieces; and tilted surfaces are provided on the upper surfaces of the stoppers. The two stoppers are placed on the supporting seat. Within the supporting seat, two springs resist against the right stopper and left stopper. Therefore, an electric shock-proof security device of a receptacle is formed. The two stoppers serve to isolate the undesired object so as not to be in contact with the conductive piece and the danger of electric shock is prevented.

2 Claims, 5 Drawing Sheets

ELECTRIC SHOCK-PROOF SECURITY DEVICE OF A RECEPTACLE

FIELD OF THE INVENTION

The present invention is directed to an electric-shockproof, security device for an electric receptacle. A right stopper and a left stopper are installed in a cover. Two prongs of an electrical plug must be the simultaneously and respectively inserted between sloping portions of the right and left stoppers. This causes the stoppers to separate and permits entry of the prongs electric receptacle for completing an electric circuit. If only one undesired substance is inserted electric shockproof security device for an electric receptacle, access to the electric receptacle is prevented, thereby preventing an electric shock.

BACKGROUND OF THE INVENTION

In the prior art receptacle, the conductive pieces are adjacent to the inserting holes. When the pins or prongs of the plug are inserted into the receptacle, they can contact the conductive piece. Although this structure has the effect of isolation, no stoppers are provided between the conductive pieces and the pins, so that a dangerous condition exists. If a child inserts an undesired substance into the inserting hole, the child can possibly get an electric shock.

Prior art designs for electrically shockproofing a receptacle are available. These include U. S. Pat. Nos. 4867694, 5281156, and 6086391.

However, in these applications, the structures of the stoppers are too complex, and a helical-type compressible spring is used. Because the space in the receptacle is small, it is difficult to insert the spring in the receptacle. In addition, the spring can elastically fatigue, thereby reducing the effectiveness of the shockproof device.

SUMMARY OF THE INVENTION

Accordingly, the primary object of the present invention is to provide an electric shock-proof security device for a receptacle, wherein two right stoppers are arranged inside the receptacle that move in opposite directions. The rear ends of the two stoppers are installed with springs, respectively, so that after the stoppers move from their normal position, they can return to the original position. Therefore, when the user desires to insert a plug, the two prongs must be inserted for the stoppers to move aside. Then the prongs can be in contact with the conductive piece. In addition, if an undesired object is inserted into one of the inserting holes, this object will be blocked, preventing the conductive piece from being touched by mistake, especially by a child.

The various objects and advantages of the present invention will be more readily understood from the following detailed description when read in conjunction with the appended drawing.

DETAILED DESCRIPTION OF THE PREFERRED EMBODIMENTS

Figure 1:
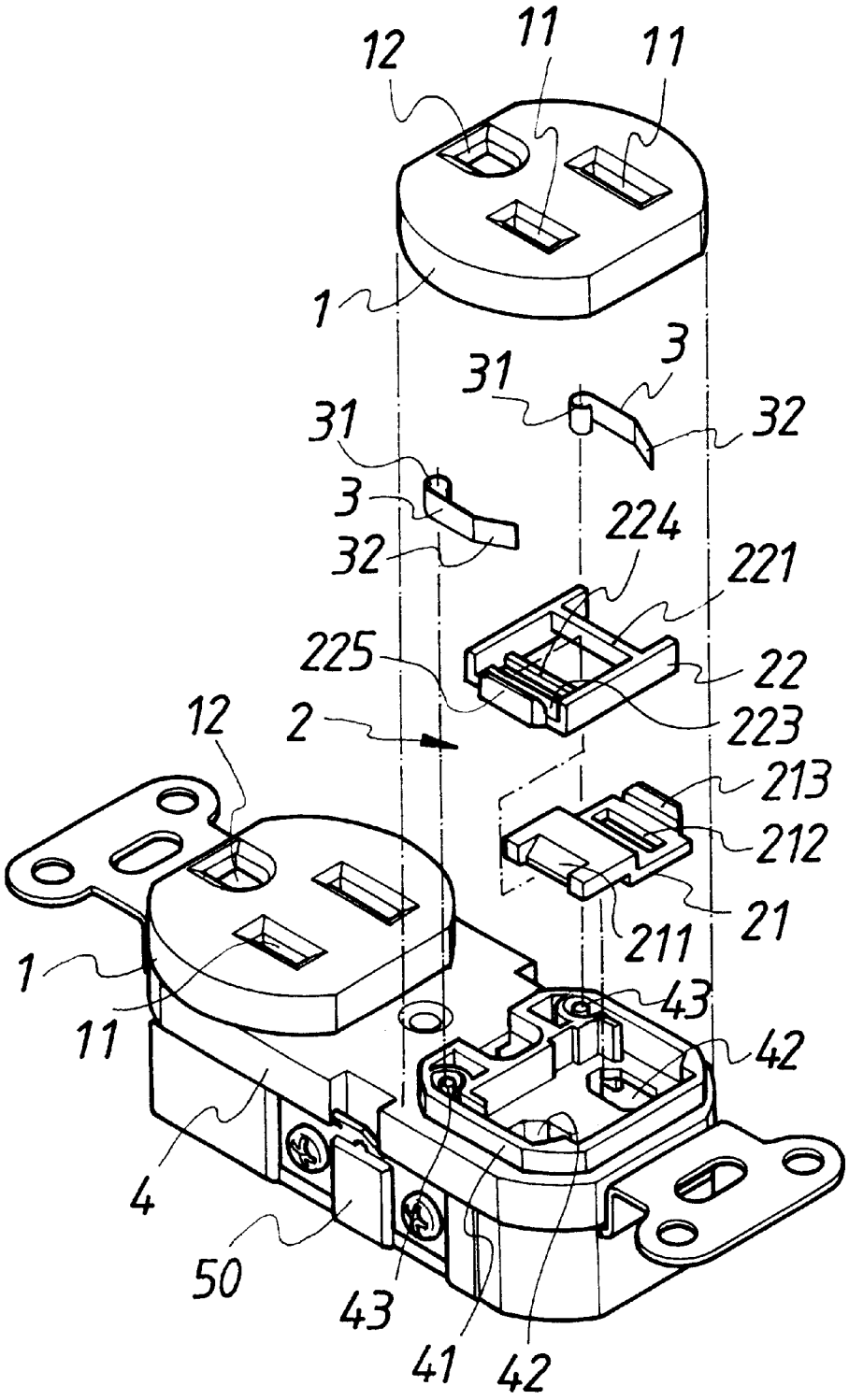
FIG. 1 is an exploded perspective view of the electric shock-proof security device of a receptacle of the present invention.
Figure 2:
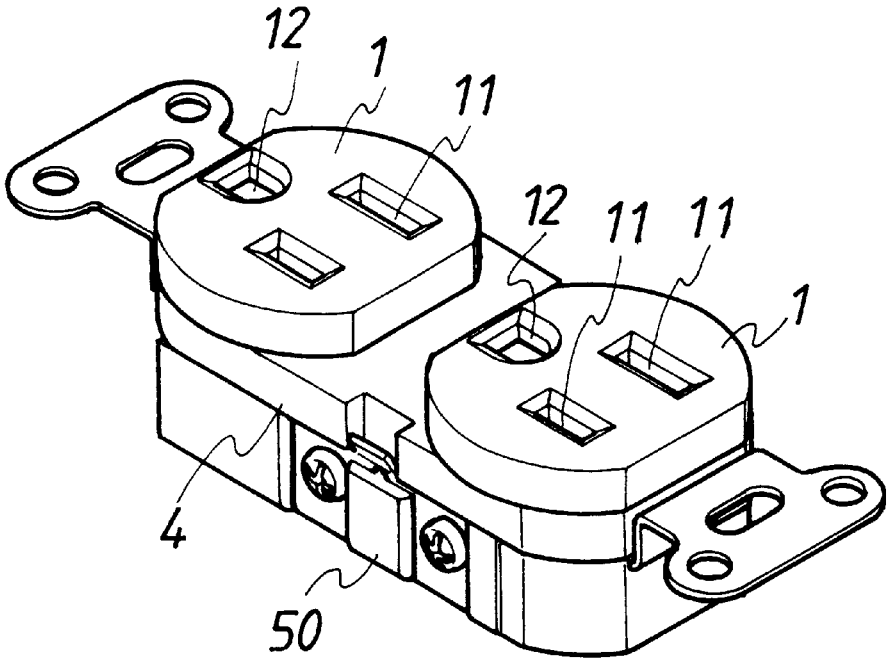
FIG. 2 is an assembled perspective view of the electric shock-proof security device of a receptacle according to the present invention.

In FIGS. 1 and 2, the electric shock-proof security device of a receptacle of the present invention is illustrated. The electric shock-proof security device of the present invention includes a cover 1, two stoppers 2, springs 3, a supporting seat 4 and other components.

The cover 1 has a function of guiding prongs for electrical connection. The shape thereof corresponds to the supporting seat 4 therebelow. The surface of the cover 1 is installed with inserting holes 11 for positive and negative electrodes.

Two stoppers 2 include a right stopper 21 and a left stopper 22. The right stopper 21 is an integrally formed stepped piece; with a concave tilt surface 211 formed at a front edge of a higher step and a rectangular through hole 212 formed at a selected surface of a lower step. A block 213 is installed at a rear edge of a lower step. Furthermore, the left stopper 22 is integrally formed as a frame and has a front strip 221 and rear strip 223. An outer side of the front strip 221 has a concave tilt surface 222. The rear strip 223 is formed as a lower recess. A further strip 224 is formed at an inner side thereof and a block 225 is formed at a rear side thereof.

Each elastomer 3 is formed by folding a long metal piece so that if the left and right stoppers 21, 22 are pushed, they can return to the original position. The rear end of the elastomer is bent in as a round cylinder 31 and the front section is bent into a tilted elastic hook 32.

The supporting seat 4 covers an insulating seat on an upper end of a prior art receptacle 50 so that the conductive piece is positioned on an insulating seat therebelow and has a slight inverted U-shape. The shape of the supporting seat 4 can be varied according to the receptacle. A frame 41 is formed at a selected portion on the surface thereof. Two through holes 42 leading to the conductive pieces are installed at the bottom of the inner portion of the frame 41. Two sides of the interior of the frame 41 are installed with post 43 for being engaged by the springs 3.

Figure 3:
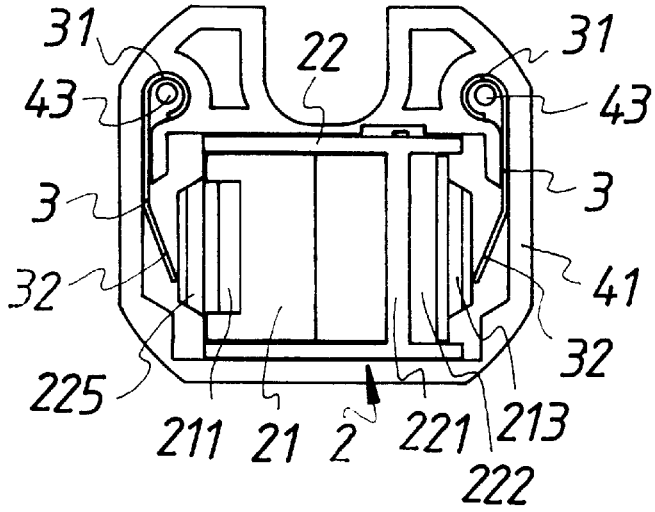
FIG. 3 is an upper view showing an assembled condition of the present invention.
Figure 4:
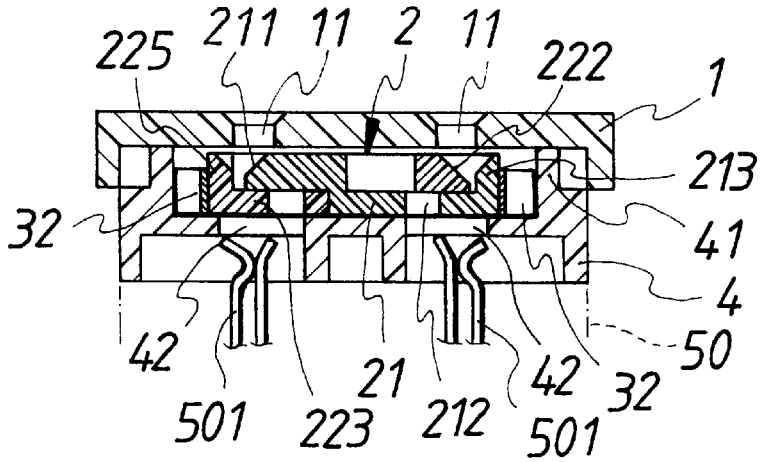
FIG. 4 is a cross sectional view of the present invention.

Accordingly, the high step portion of the right stopper 21 passes through the left stopper 22 and is overlapped with the rear strips 223 and 224 of the left stopper 22 so that the right stopper 21 covers the hollow portion of the left stopper 22 and the through hole 212 of the right stopper 22 is covered by the front strip of the left stopper 21. Thus, the left stopper 22 and right stopper 21 slide in tandem with one another. The right stopper 21 and left stopper 22 are installed in the frame 41 of the supporting seat 4 to exactly cover the through hole 42 on the bottom of the frame 41 (referring to FIG. 3). The two posts 43 in the frame 41 of the supporting seat 4 hold the round cylinders 31 of the springs 3 so that the front elastic hooks 32 at the front end extend to the two sides of the interior of the frame 41, and resist against the blocks 213, 225 at the rear sides of the right stopper 21 and left stopper 22. By this elasticity, the right stopper 21 and left stopper 22 are sealed in the normal position (referring to FIG. 4). The cover 1 covers the frame 41 of the supporting seat 4 for guiding insertion into the receptacle. Therefore, the electric shock-proof security device of a receptacle of the present invention is formed.

Figure 5:
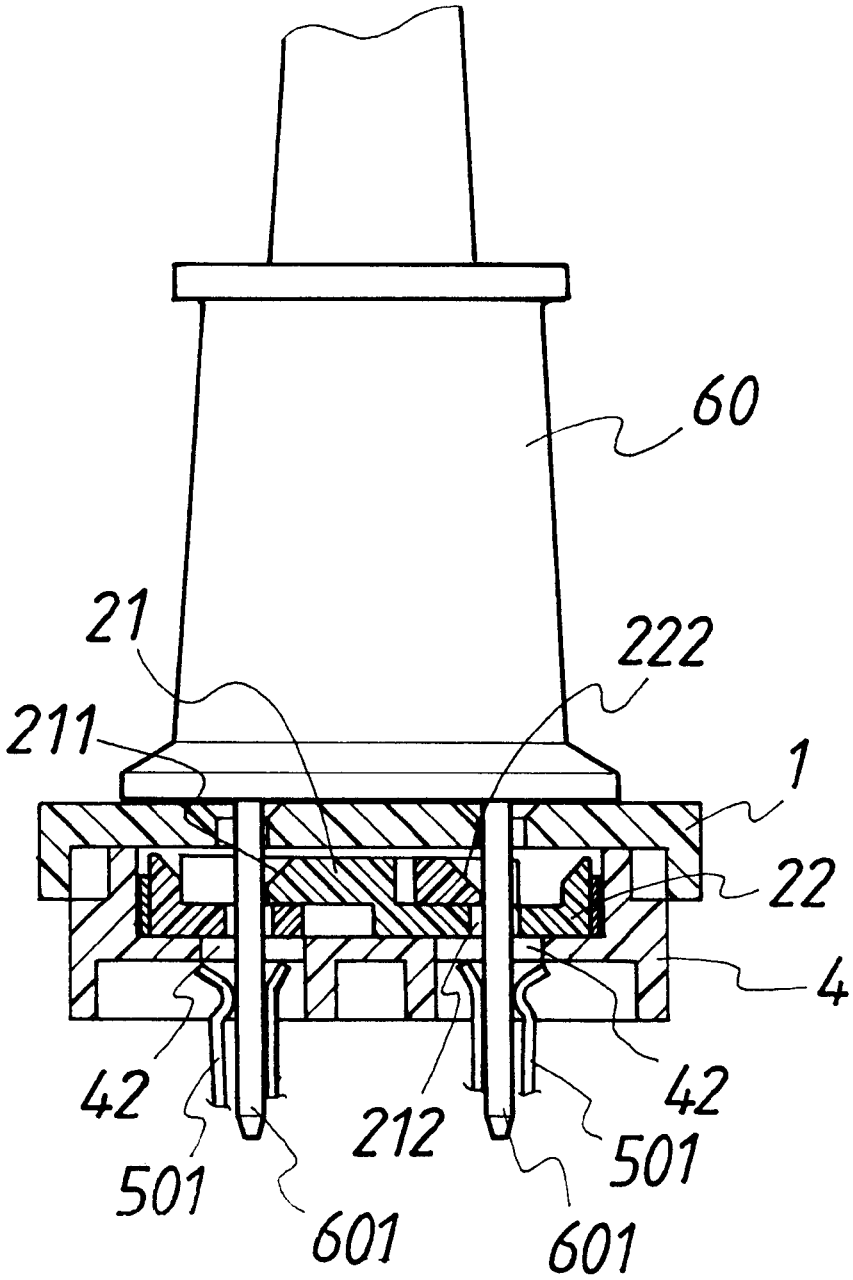
FIG. 5 is a schematic view showing the use of the present invention.

The present invention is constructed to prevent undesired objects from being inserted into the receptacle by carelessness, resulting in an electric shock to the user. Referring to FIG. 5, in a normal condition, when two prongs 601 of a normal plug 60 are inserted into the inserting holes 11 of the cover 1 at the same time, they resist against the tilt surfaces 211, 222 of the right stopper 21 and left stopper 22 so that the right stopper 21 and left stopper 22 are pushed inwards. Thus, a hollow portion of the left stopper 22 and the through hole 212 of the right stopper 21 are exposed and can be passed by prongs 601 and then the prongs pass through the through holes 41 of the supporting seat 4 and makes contact with the conductive piece 501. In the present invention, in a normal situation the user's hand holds the receptacle 60 and no danger occurs. When the receptacle 60 is pulled out, the left stopper 22 and right stopper 21 resist against the elastomer 3, causing them to return to their original position.

Figure 6:
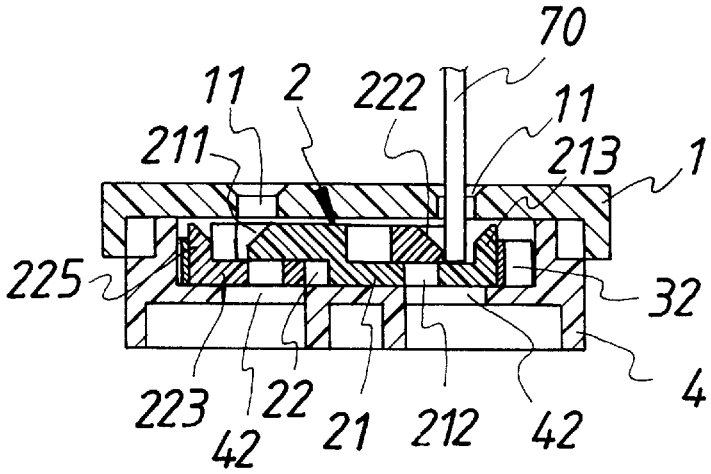
FIG. 6 is a schematic view showing the present invention preventing an undesired substance from being inserted into the receptacle.
Figure 7:
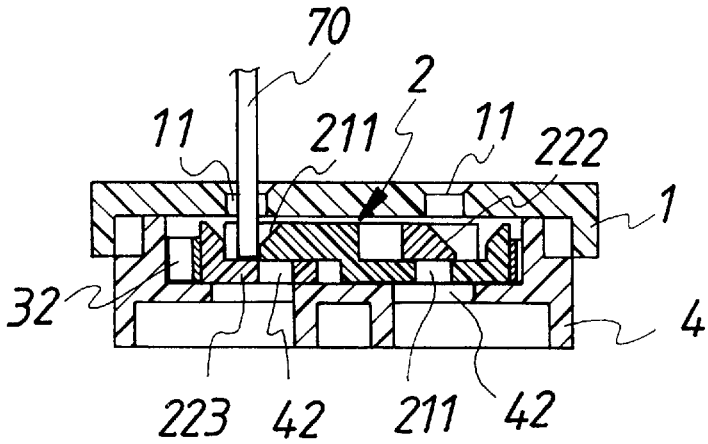
FIG. 7 is another schematic view showing the present invention preventing an undesired substance from being inserted into the receptacle.

In an atypical situation, the right stopper 21 and left stopper 22 block undesired objects 70, such as steel wires or bolts, etc., as shown in FIGS. 6 and 7. For example, if an undesired object is inserted into the inserting hole 11 of the cover 1 and pushes the left stopper 22, the left stopper 22 will move upwards due to the tilted surface 222. The undesired object 70 can enter the receptacle, but only slightly. Since the right stopper 21 is not pushed at the same time, it is blocked by the lower stepped portion and cannot pass through the through hole 212. On the other hand, if the undesired object 70 is inserted from another end, since the left stopper 22 is not pushed at the same time, it is hindered by the strip 223 at the rear side and the undesired object 70 cannot be inserted any further into the receptacle 50 to be in contact with the conductive piece 501. Therefore, no matter which hole an undesired object is inserted into, no current will be conducted back to the user. Consequently, improper use of a receptacle, such as the insertion of an undesired object, will not result in the danger of electric shock.

Therefore, the present invention has substantial benefit in preventing electric shock by the improper use of the receptacle. Since two stoppers are installed below the cover 1, dust or other impurities cannot migrate to the conductive piece 501 so that conductivity is sustained. The embodiment of the present invention is confined to the aforesaid receptacle 50. However, the present invention can be used in any movable receptacle with an extension cord and create a receptacle that is electrically shock-proof.

As the present invention is described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric shockproof security device for an electric receptacle, which comprises a cover, right and left stoppers, springs and a supporting seat;

the supporting seat being made of an electrical insulating material and being adapted to cover an insulating seat at an upper end of an electric receptacle, the supporting seat including a frame for receiving the two stoppers, springs and cover; the frame including holes adapted for prongs of an electric plug to pass therethrough, and posts for respectfully holding ends of the springs;

the cover including holes adapted for prongs of an electric plug to pass therethrough, the holes of the cover being aligned with the holes of the frame, and the surface of the cover adjacent the holes of the cover being beveled for guiding prongs of an electric plug into the holes of the cover;

the right stopper having an integral structure with an upper section and a lower section, the upper and lower sections including flat portions, ends of the flat portions of the upper and lower sections being joined together by a stepped portion, another end of the upper section including a first sloping surface adapted to interact with a prong of an electric plug, the lower section having a middle portion with a rectangular hole, another end of the lower section having a block that protrudes upwardly, and the block having a second sloping surface adapted to interact with a prong of an electric plug;

the left stopper having an integral structure including a frame; the frame including side panels with front, middle and rear strips extending between the side panels; an outer side of the front strip including a third sloping surface adapted to interact with a prong of an electric plug, the rear strip including a lower recess and a block that protrudes upwardly, and the block of the rear strip of the left stopper having a fourth sloping surface adapted to interact with a prong of an electric plug;

the springs being respectively formed by folding a long metal piece; a first end of the long metal piece having a cylinder and a second end of the long metal piece being bent to provide elastic resilience;

the right stopper being arranged within the left stopper; so that the upper section of the right stopper rides on the middle strip and the lower recess of the rear strip of the left stopper, the front strip of the left stopper rides on the lower section of the right stopper, the first sloping surface of the right stopper faces the fourth sloping surface of the right stopper, the second sloping surface of the right stopper faces the third sloping surface of the right stopper; the cylinders of the springs are arranged about the post of the supporting seat and the second ends of the springs are arranged to bias the first sloping surface of the right stopper toward the fourth sloping surface of the right stopper and to bias the second sloping surface of the right stopper toward the third sloping surface of the right stopper, so that the holes of the frame are covered and access to electrical contacts is prohibited; and the right and left stoppers working together to prohibit access to the holes of the frame when an item is individually inserted between the first sloping surface of the right stopper and the fourth sloping surface of the right stopper, and when an item is individually inserted between the second sloping surface of the right stopper and the third sloping surface of the right stopper; and the right and left stoppers working together to permit access to the holes of the frame when two electrical prongs are simultaneously and respectively inserted between both the first sloping surface of the right stopper and the fourth sloping surface of the right stopper and the second sloping surface of the right stopper and the third sloping surface of the right stopper.

2. The electric shockproof security device for an electric receptacle, as claimed in claim 1, wherein the cover is includes a ground hole adapted to receive a ground in prong of an electrical plug.

* * * * *